US009260831B2

(12) United States Patent
Poscich

(10) Patent No.: US 9,260,831 B2
(45) Date of Patent: Feb. 16, 2016

(54) HYDROFISSION BARRIER

(71) Applicant: Douglas Poscich, North Stonington, CT (US)

(72) Inventor: Douglas Poscich, North Stonington, CT (US)

( * ) Notice: Subject to any disclaimer, the term of this patent is extended or adjusted under 35 U.S.C. 154(b) by 0 days.

(21) Appl. No.: 14/155,055

(22) Filed: Jan. 14, 2014

(65) Prior Publication Data

US 2014/0199123 A1 Jul. 17, 2014

Related U.S. Application Data

(60) Provisional application No. 61/753,210, filed on Jan. 16, 2013.

(51) Int. Cl.

| | |
|---|---|
| ***E02B 3/12*** | (2006.01) |
| ***E02B 15/08*** | (2006.01) |
| ***E02B 3/06*** | (2006.01) |

(52) U.S. Cl.

CPC . *E02B 15/08* (2013.01); *E02B 3/06* (2013.01); *E02B 3/062* (2013.01)

(58) Field of Classification Search

CPC ..... E02B 3/12; E02B 3/06; E02B 3/04; E02B 3/062; E02B 15/08; E02B 3/064; A01K 61/006; B22C 9/24

USPC ..... 405/15, 16, 17, 20, 21, 22, 23, 25, 26, 405/27, 28, 30, 31, 33, 35, 107, 111, 114

See application file for complete search history.

(56) References Cited

U.S. PATENT DOCUMENTS

| | | | | |
|---|---|---|---|---|
| 2,886,951 | A * | 5/1959 | Valembois | 405/31 |
| 2,994,201 | A * | 8/1961 | Hutchings | 405/27 |
| 3,820,343 | A * | 6/1974 | Morren | 405/286 |
| 4,129,006 | A | 12/1978 | Payne | |
| 4,511,286 | A | 4/1985 | Hardacre | |
| 4,896,996 | A | 1/1990 | Mouton et al. | |
| 5,061,122 | A | 10/1991 | Chattey | |
| 5,536,112 | A | 7/1996 | Oertel, II | |
| 5,827,011 | A * | 10/1998 | Kann | 405/27 |
| 6,158,922 | A * | 12/2000 | Fernandez | 405/21 |
| 6,672,800 | B2 * | 1/2004 | Frank | 405/115 |
| 6,896,445 | B1 | 5/2005 | Engler | |
| 7,520,237 | B1 | 4/2009 | Dimov Zhekov | |
| 7,572,083 | B1 | 8/2009 | Bishop et al. | |

(Continued)

FOREIGN PATENT DOCUMENTS

WO 9957376 A1 11/1999

*Primary Examiner* — John Kreck
*Assistant Examiner* — Carib Oquendo
(74) *Attorney, Agent, or Firm* — Adler Pollock & Sheehan P.C.; Daniel J. Holmander, Esq.; George N. Chaclas, Esq.

(57) ABSTRACT

A barrier system and a method for dissipating energy in a body of fluid provides one or more barrier units each having an outer wall that defines a hollow inner chamber. Each barrier unit has a lower aperture and an upper aperture so fluid can flow in and out of the hollow inner chamber. Upward movement of fluid within the inner chamber is deflected inwardly and energy of the fluid is dissipated. The buoyancy of the barrier unit is controlled by a control system. Multiple barrier units can be used together to dissipate energy within a body of water over a large area. The barrier units can be easily assembled and deployed into a body of water. Where the barrier system is used in an ocean or another large body of water, the barrier units may be deployed from a ship, and may be anchored to the seafloor.

21 Claims, 11 Drawing Sheets

(56) References Cited

U.S. PATENT DOCUMENTS

| | | | | |
|---|---|---|---|---|
| 7,708,495 | B1 | 5/2010 | Antee | |
| 2003/0035690 | A1 | 2/2003 | Earl | |
| 2005/0053429 | A1 | 3/2005 | Davidsaver et al. | |
| 2006/0159518 | A1 * | 7/2006 | Cravens | 405/16 |
| 2008/0155929 | A1 | 7/2008 | Herron | |
| 2008/0279634 | A1 | 11/2008 | Heselden | |
| 2009/0173386 | A1 | 7/2009 | Bowers et al. | |
| 2010/0147206 | A1 | 6/2010 | Leonov et al. | |
| 2010/0170958 | A1 | 7/2010 | Rosenfeld et al. | |
| 2010/0310313 | A1 * | 12/2010 | Kohlenberg | 405/30 |
| 2010/0326001 | A1 | 12/2010 | Herron | |
| 2010/0329785 | A1 | 12/2010 | Nero | |
| 2013/0125825 | A1 * | 5/2013 | Kania et al. | 119/221 |
| 2014/0314484 | A1 * | 10/2014 | Pierce, Jr. | 405/31 |

* cited by examiner

HYDROFISSION BARRIER

CROSS REFERENCE TO RELATED APPLICATION

This application is related to and claims priority from earlier filed provisional patent application Ser. No. 61/753,210, titled "Hydrofission Barrier," filed Jan. 16, 2013, the entire contents thereof is incorporated herein by reference.

BACKGROUND

The present invention relates generally to the field of protecting coastal regions and waterfront property or waterfront investments.

Waterfront property is particularly vulnerable to weather conditions. Wind and waves can erode waterfront property over time, and more powerful conditions such as hurricanes and tsunamis can do more damage over a much shorter period of time. With some scientists predicting large increases in hurricane activity along with increases in sea level in the coming years, waterfront property is expected to become even more vulnerable to weather related events. In this regard, it is desirable to provide a barrier system that can provide a water barrier in order to protect coastal regions, waterfront properties, and waterfront investments.

BRIEF SUMMARY OF THE INVENTION

Accordingly, the present invention provides a barrier system formed of multiple barrier units for protecting people and property from hazards. In particular, the invention provides a hydrofission barrier system formed of multiple hydrofission barrier units for dissipating energy in ocean water and containing ocean contaminants. The instant invention provides a barrier system for dissipating energy in a body of fluid. The barrier system includes at least one barrier unit. Where more than one barrier unit is used, they may be arranged in a pattern or an array. To allow fluid to flow in and out of the barrier unit, each barrier unit has an outer wall that defines a hollow inner chamber, which has a lower aperture at the lower end of the barrier unit and an upper aperture at the upper end of the barrier unit. A buoyancy control system helps the barrier unit float in a fluid. When a fluid moves upwardly within the inner chamber of the barrier unit, the fluid is deflected inwardly and the energy of the fluid is dissipated.

The hydrofission barrier system features a very simple, two-piece, clamshell design based on a geometric shape that is converging toward one end. Congruent shells are assembled together at their opposing faces to form a cone-like shape. The shells have a hinge system down each side with alternating tabs for interconnection, with connecting rods extending through the tabs. The connecting rods also act as buoyancy compensators through the use of positive buoyancy.

The system can be deployed either by a vessel or via a cable pull system. When not deployed, the system can be stored in a semi-disassembled to fully disassembled configuration that requires minimal space and can be easily re-deployed. The individual units are fully scalable to accommodate various deployment requirements, from a simple backyard barrier to a large, open-ocean suppression oasis.

The system can be maintained in either a free-floating configuration, an anchored system, or a structural footing that is either land-based or ocean-based. The system can employ a counter measure to maintain upright stability. The buoyancy compensation can be either static or dynamically controlled.

The barrier unit tapers so that its upper end is narrower than its lower end. In one embodiment, the barrier unit has a conical shape.

A barrier system can include multiple barrier units, at least some of which are connected to each other by a linking element. This facilitates control of the spatial arrangement of the barrier units in the fluid. The linking elements can cause the barrier units to be substantially evenly spaced apart. Barrier units in a barrier system can be arranged in an array, or a shape such as a circle, a straight line, a triangle, a rectangle, or another shape.

To further facilitate spatial arrangement of the barrier system, one or more barrier units may be connected to a mooring anchor so the respective barrier unit is substantially positionally secured relative to the bottom surface of the body of fluid.

The barrier units do not need to be secured to the bottom of surface of the body of fluid, and may instead be free floating.

The outer wall of the barrier unit can be an easily assembled clamshell design. A front shell and a rear shell each form a half of the clamshell design, and can be connected by hinge elements on the front shell and the rear shell. The front and rear shells can be secured together to form a shape that is conical or frustoconical, or another shape.

The front and rear shells can be secured to one another by various methods. In one method, a first connecting rod extends through hinges on the first side of the front shell and the first side of the rear shell, and a second connecting rod extends through the hinges on the second side of the front shell and the second side of the rear shell.

The barrier unit may be buoyant, but the barrier unit may have a buoyancy control system to affect the natural buoyancy of the barrier unit. The buoyancy control system of the barrier system may include a fluid that is within one or both of the connecting rods.

The first and second connecting rod may be integrally formed. This is particularly where the first and second connecting rods contain the buoyancy control fluid for the buoyancy control system.

A system of barrier units may include various sets of barrier units having different sizes. In this system. For example, a row of smaller barrier units could be placed closer to an ocean shoreline, and a row of larger barrier units could be placed further out to sea.

The present invention also provides a method of suppressing the effects of a storm on a coastline. The method includes the steps of providing a barrier system having barrier units for dissipating energy in a body of a first fluid, and providing a buoyancy compensation system for the plurality of barrier units. The barrier units and the buoyancy control system are described above.

The present invention also provides a method of assembling and deploying the barrier units from a stack of front and rear shells. A front shell (panel) and a rear shell (panel) are each removed from a stack and assembled together to form a barrier unit. The user then deploys the barrier unit, for example by placing the barrier unit into a body of water from a ship. The user can then assemble and deploy additional barrier units as needed.

The step of deploying the barrier unit can be performed by using a cable pull system.

Therefore, it is an object of the present invention to prevent or suppress coastal damage due to weather-related events, and to prevent destruction of beaches due to normal tidal erosion of the coastline.

It is further an object of the present invention to create artificial reefs and/or a barrier system to create wave patterns that are favorable for specific coastal regions, such as waves that are optimal for surfing.

It is further an object of the present invention to deploy and retrieve a low-cost barrier system that will form a wall that helps dissipate wave energy, trap wave energy internal to a geometric shell, thereby creating a dampening effect on the water as it rises within the shell, create a vortex system as the wave pushes up on the air within the geometric shell.

It is further an object of the present invention to deploy a low-cost barrier system that will accelerate the air and cool the air, thereby lowering the ambient air temperature. The present invention will accelerate the velocity of the air at a perpendicular path to the weather-related air system, resulting in a turbulent air layer that slows the surface velocity of the wind, and, in its extreme state, roll to an angle and form a funnel cone that reduces the wave energy.

It is further an object of the present invention to provide a barrier system that can remain in the water at a subsurface level and be deployed either manually or remotely through a control system.

It is further an object of the present invention to provide a barrier system that will support various types of alternative energy sources.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated of carrying out the present invention.

DETAILED DESCRIPTION OF THE PREFERRED EMBODIMENT

Figure 1A:
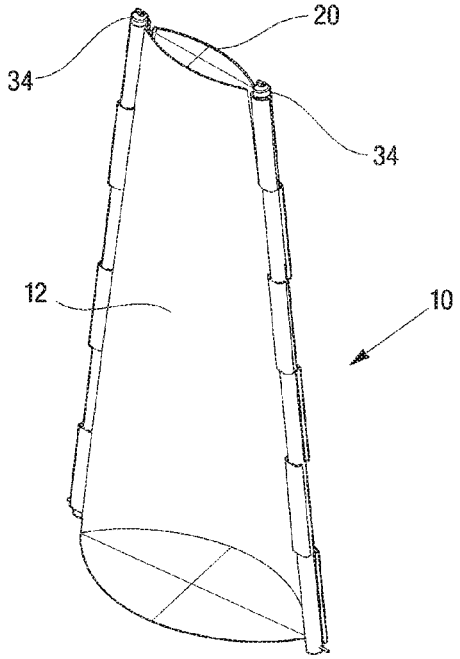
FIG. 1*a* shows a perspective view of one embodiment of a barrier unit.
Figure 1B:
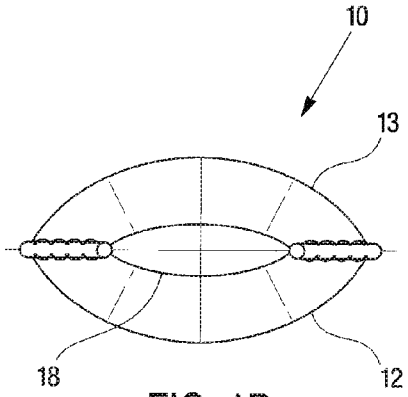
FIG. 1*b* shows a top view thereof.
Figure 1C:
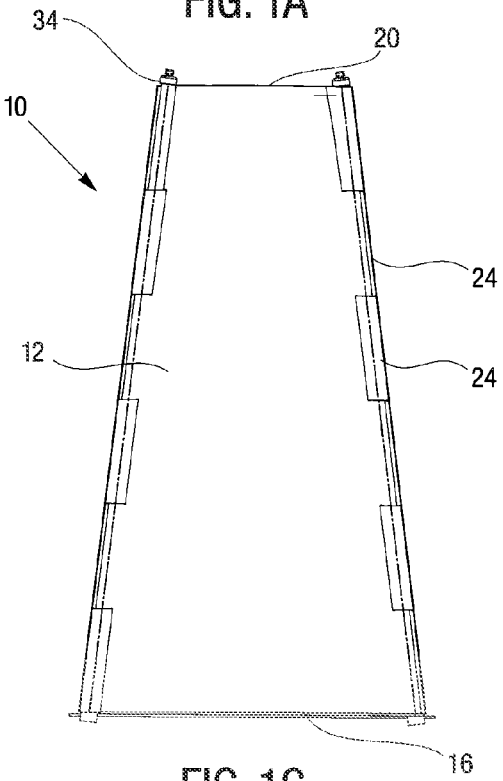
FIG. 1*c* shows a front view thereof.
Figure 1D:
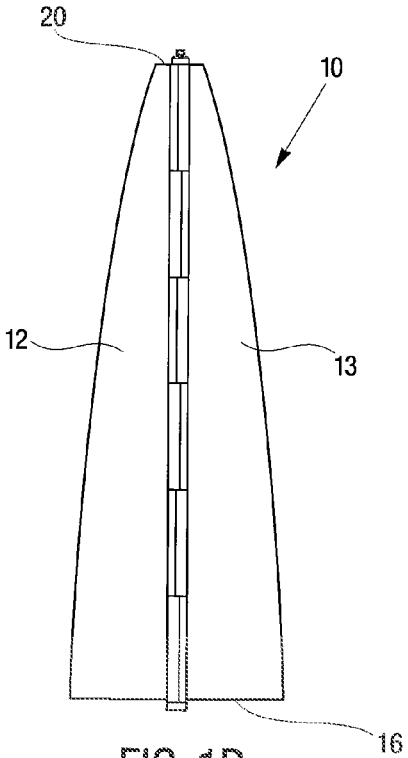
FIG. 1*d* shows a side view thereof.

Referring now to the drawings, the barrier system of the instant invention is illustrated and generally indicated at 10 in FIGS. 1-13. As will hereinafter be more fully described, the instant invention provides a system and method for dissipating fluid energy in a body of fluid.

The present invention provides an easily deployable barrier system that is easily assembled from barrier panels in order to protect humans and property from harm. In particular, the present invention can prevent or suppress coastal damage due to weather-related events and to prevent destruction of beaches due to normal tidal erosion of the coastline. The present invention can create artificial reefs and/or a barrier system to create wave patterns that are favorable for specific coastal regions, such as waves that are optimal for surfing.

Throughout this description, the terms "body of fluid" and "body of water" may be used to describe the environment in which the barrier units are used. Where "body of water" is used, it is not meant to limit the application of the invention to a water-containing environment. It is to be understood that the barrier units can be used in fluids other than water.

FIGS. 1*a*-1*d* show a first embodiment of the barrier unit 10 for dissipating energy in a body of fluid 11. The barrier unit has two barrier panels (or clamshells or shells) 12, 13 that form an outer wall that defines a hollow inner chamber. Fluid can enter and exit the hollow inner chamber through a lower aperture 14 at the lower end 16 of the barrier unit and an upper aperture 18 at the upper end 20 of the barrier unit. This very simple, two-piece, clamshell design is based on a geometric shape that is converging on one end. The shells 12, 13 are designed to be the same shape and, when attached at opposing faces, form a barrier unit 10 having a cone shape. Thus, the barrier units 10 are tapered inward so that the width of the barrier unit decreases with height, forming the trapezoidal front profile shown in FIG. 1*c*. The barrier units are also curved inward so that the depth of the barrier unit decreases with height, forming the tapered side profile shown in FIG. 1*d*. The inwardly sloping walls help the barrier unit 10 deflect fluid moving within the barrier unit, which dissipates energy within the fluid, as discussed in more detail below. Thus, the barrier unit 10 of FIGS. 1*a*-1*d* is shaped as the frustum of a substantially conical shape. The barrier unit could be another shape such as the frustum of a cone, a cone, or another shape with internal walls that are useful for deflecting fluid in the inner chamber, as discussed in more detail below.

The shells/panels 12, 13 can be fabricated out of various materials including, but not limited to, composites, plastics, and metals, or any combination thereof, depending upon the desired load requirements and cost. Additional materials typically used for buoys may also be used.

The individual barrier units 10 are fully scalable to accommodate various deployment requirements, from a simple backyard barrier to a large, open-ocean suppression oasis. Thus, the panels may be formed in many sizes. For example, the panels may be 20 feet tall, 10 feet tall, or 5 feet tall. Other heights are also within the scope of the present invention.

The barrier unit 10 is designed to float in a fluid 11, such as water in an ocean or another body of water. The barrier unit 10 may have a buoyancy control unit 22 to adjust the buoyancy of the barrier unit 10. The buoyancy control unit 22 allows the barrier units to be seated on the bottom surface of the body of water or to be floating below the water surface when the buoyancy control unit is in a first state. When the buoyancy control unit is activated to a second state, the buoyancy control unit causes the barrier units to float higher in the water. The buoyancy control unit can thus be used to cause barrier units to move back and forth between a position in which they are submerged to a position in which they extend partially above the water surface. This is useful for a barrier system that is only needed sometimes, for example, during storms or times of high wave energy. The barrier units can be submerged to allow swimmers and watercraft to use the water above the barrier units. The submerged barrier units also provide a more scenic view to people looking at the ocean from the beach. When wave energy increases, the barrier units can be brought partially above the surface to protect the beach area from at least some of the incoming wave energy.

Figure 2:
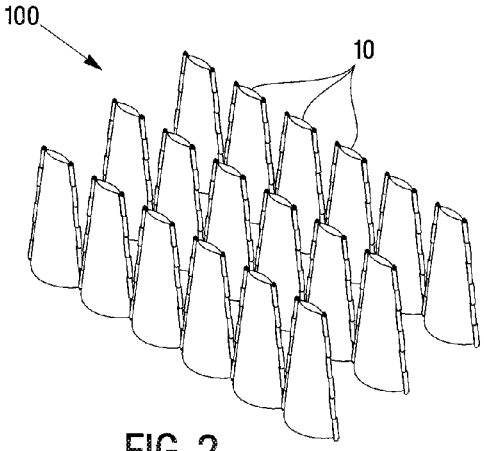
FIG. 2 shows a stacked deployment of barrier units.
Figure 3:
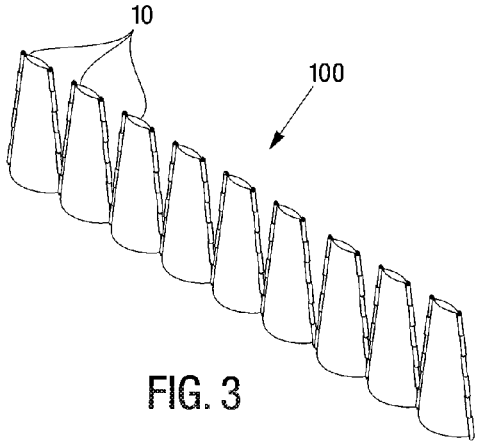
FIG. 3 shows a straight line deployment of barrier units.
Figure 4:
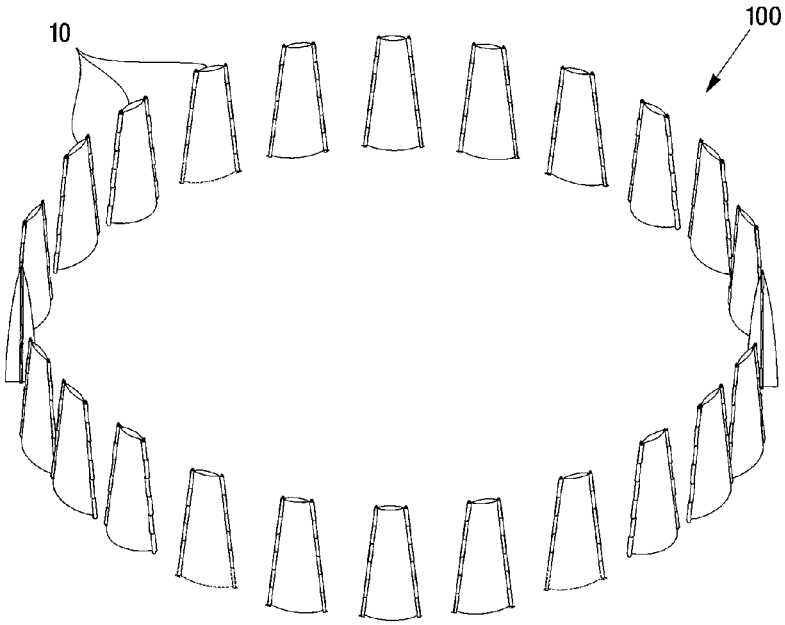
FIG. 4 shows a circular deployment of barrier units.

In the barrier system, the barrier units 10 can be used alone or in groups. In the deployed state, the barrier units of each barrier system can be connected in various configurations depending upon how many units are used and how the units are linked to each other. FIGS. 2-4 show examples of floating arrangements 100 of more than one barrier unit 10. FIG. 2 shows a grouping of 18 barrier units arranged in array having three rows of six barrier units 10 each. FIG. 3 shows a straight line deployment of eight barrier units 10. FIG. 4 shows a circular deployment of barrier units 10. It is possible to arrange the barrier units in other shapes, including a straight line, a wedge formation, a circular formation, a triangle, a pyramid, a rectangle, a square, for example.

The barrier system may have additional features to control the position and orientation of the barrier units. The system can be maintained in either a free-floating configuration, an anchored system, or a structural footing that is either land-based or ocean-based. The system can employ a counter measure to maintain upright stability.

To help secure the barrier units in the desired arrangement with respect to one another, each barrier unit can be connected to at least one other barrier unit by one or more linking elements. This allows the barrier units to float in the fluid with substantially even and/or substantially constant spacing over time. The linking elements may be rods, ropes, chains, or other structures.

The barrier units can also be secured to the bottom surface of a body of fluid, such as an ocean floor, to substantially positionally secure the barrier units relative to the bottom surface of the body of fluid. For example, where the barrier units are being used to prevent or limit beach erosion caused by water waves, it is useful to substantially secure the barrier units in the water near the beach.

Figure 5A:
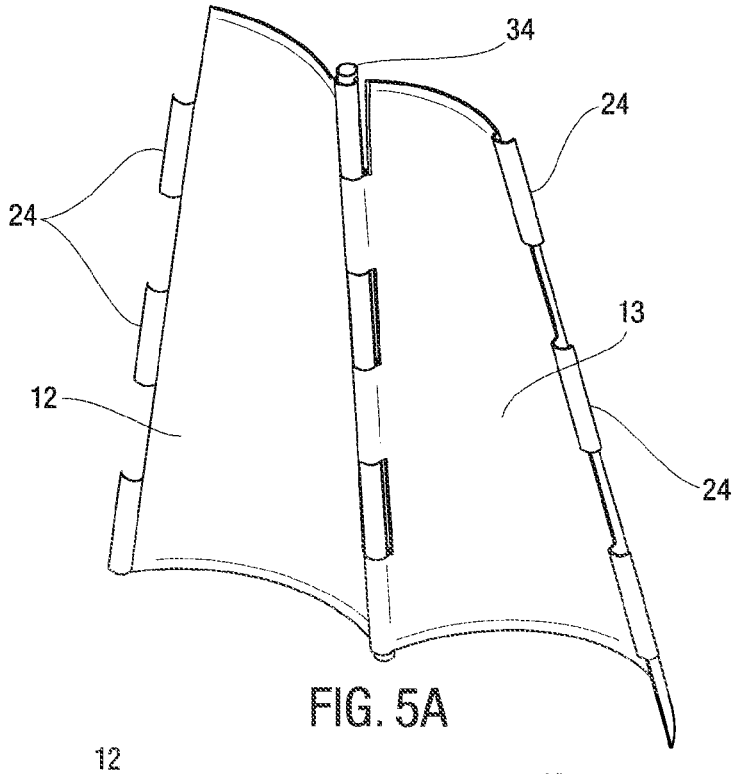
FIG. 5*a* shows a perspective view of a partial assembled storage configuration.
Figure 5B:
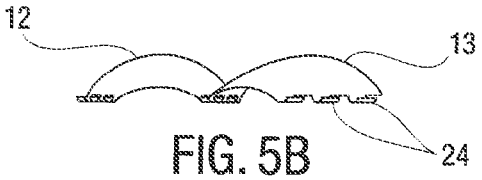
FIG. 5*b* shows a top view thereof.
Figure 5C:
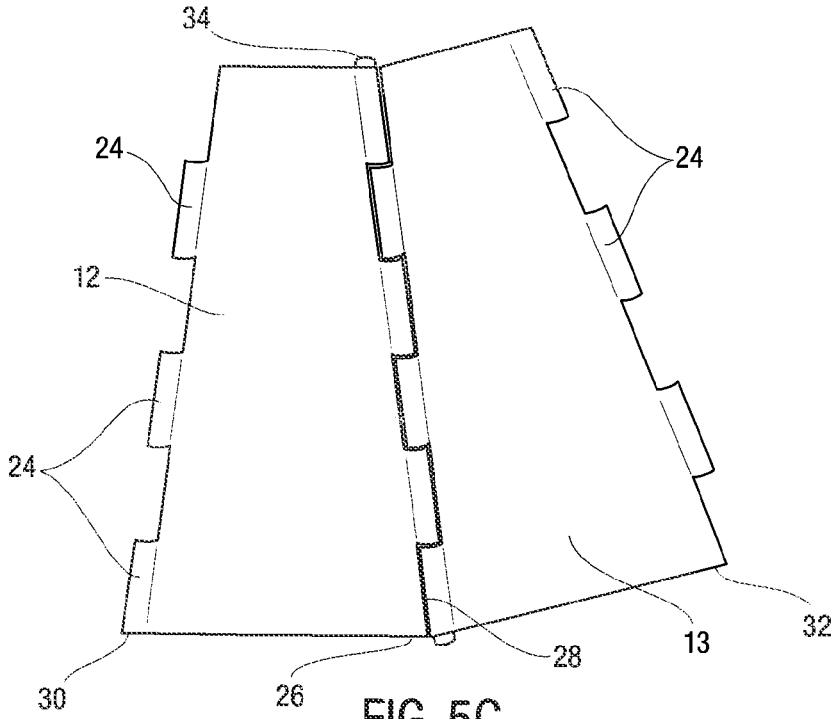
FIG. 5*c* shows a front view thereof.
Figure 6A:
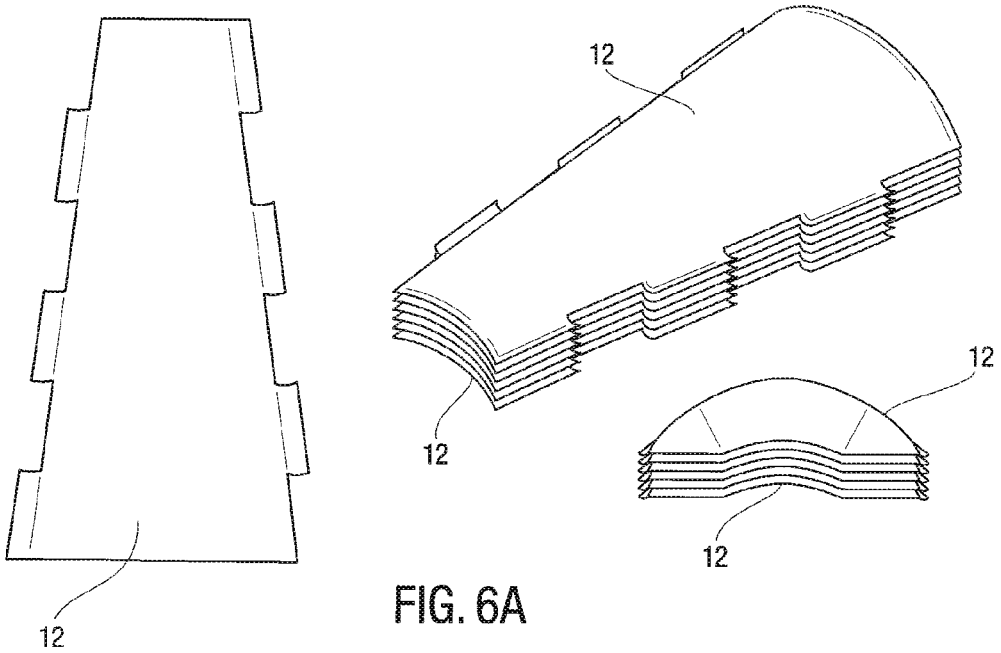
FIG. 6*a* shows unassembled barrier panels stacked for storage.
Figure 6B:
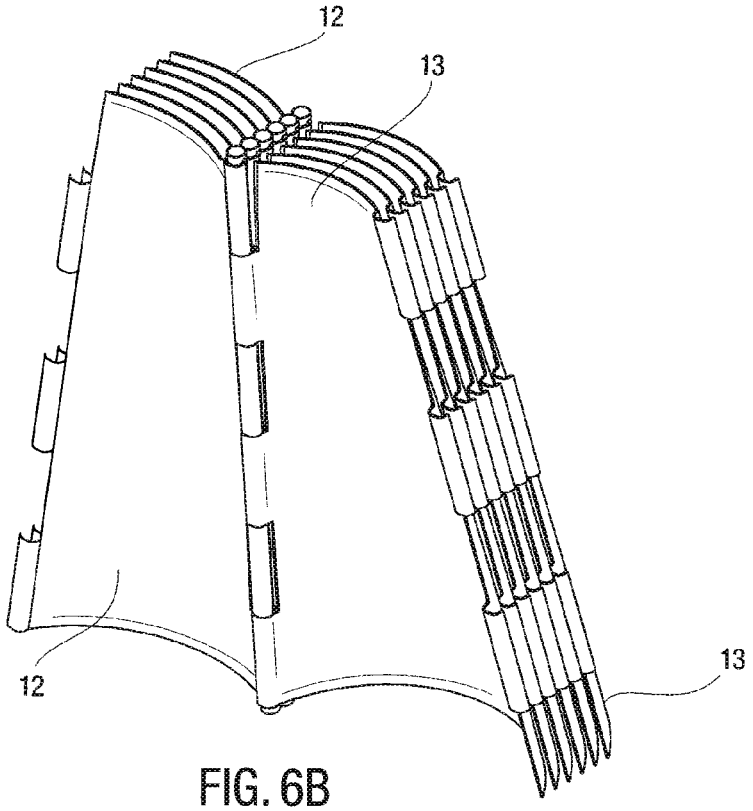
FIG. 6*b* shows partially assembled barrier panels stacked for storage.

The system can be stored in a semi-disassembled to fully disassembled configuration that requires minimal space and can be easily re-deployed. FIGS. 5*a*-6*b* show how the panels 12, 13 may be stored in stacks of individual panels, or in stacks of partially assembled panels. In FIGS. 5*a*-5*c*, the first embodiment of a barrier unit 10 has a first shell (front shell) 12 and a second shell (rear shell) 13. When the first shell/panel 12 and the second shell/panel 13 are joined together, they form a front wall of the barrier unit and a rear wall of the barrier unit, respectively. The first shell and the second shell each have a first side and a second side. In the embodiments shown in FIG. 6*b*, the individual panels of FIG. 6A are assembled into pairs and then stacked.

The shells have an interlocking structure that allows two or more shells to be connected. In one embodiment, a piano-type hinge system is placed along each side of the panel so that the alternate tabs can engage another panel. Once the tabs of two panels are aligned, a connecting rod is inserted into the tabs of the shells to form a hinged connection of the shells. In the embodiment with a front shell and a rear shell, the front and rear shells are joined together by hinges 24 located at first and second sides. The first side 26 of the front shell has a hinge structure 24 that engages a hinge structure 24 on the first side 28 of the rear shell. The second side 30 of the front shell has a hinge structure 24 that engages a hinge structure 24 on the second side 32 of the rear shell. When the hinge structures 24 are aligned, a first connecting rod 34 extends through the hinges on the first side of the front shell and the first side of the rear shell, and a second connecting rod extends through the hinges on the second side of the front shell and the second side of the rear shell. An upper end of the connecting rod 34 is visible, for example, in FIGS. 1*a*, 1*c*, 5*a*, 5*c*.

The connecting rods 34 act as buoyancy compensators through the use of positive buoyancy, for example by way of air, foam, or low-density material that is captured within the connecting rods 34. Other hinge structures or other fastening means may be employed without departing from the scope of this invention.

In FIGS. 1*a*-1*d*, two connecting rods 34 are shown, with a first connecting rod on the first side of the panels, and a second connecting rod on the second side of the panels. The first and second connecting rods can be integrally formed. For example, a substantially U-shaped connector has a first end that extends through the hinges on the first side and a second end that extends through the hinges on the second side.

The buoyancy compensation can be either static or dynamically controlled. In one embodiment, the dynamic controller may control air pressure to direct air into the connecting rods to raise or lower the units while in the water and maintain a certain exposure height above the waterline or a desired floating height below the waterline. In other embodiments, similar buoyancy controllers may be attached to the barrier units.

Alternatively, the connecting rods can be replaced with one or more connecting tubes 36. Such a connecting tube could extend through the hinges on the first side as well as the hinges on the second side, and then extend through hinges on adjacent barrier units, as shown in FIG. 9*b*. An air pump 38 at a first end of the connecting tube 36 could pump air into the connecting tube 36 as needed, to increase the buoyancy of the barrier units. The connecting tube can be closed at its second end, so air can be pumped into the tube and then removed from the connecting tube. Other connecting tube structures and methods of providing a buoyant fluid into the connecting tube are possible without departing from the scope of the present invention. The buoyant fluid is less dense than the fluid in the body of fluid. For example, the buoyant fluid could be air and the barrier unit could be placed in a body of water.

Figure 7:
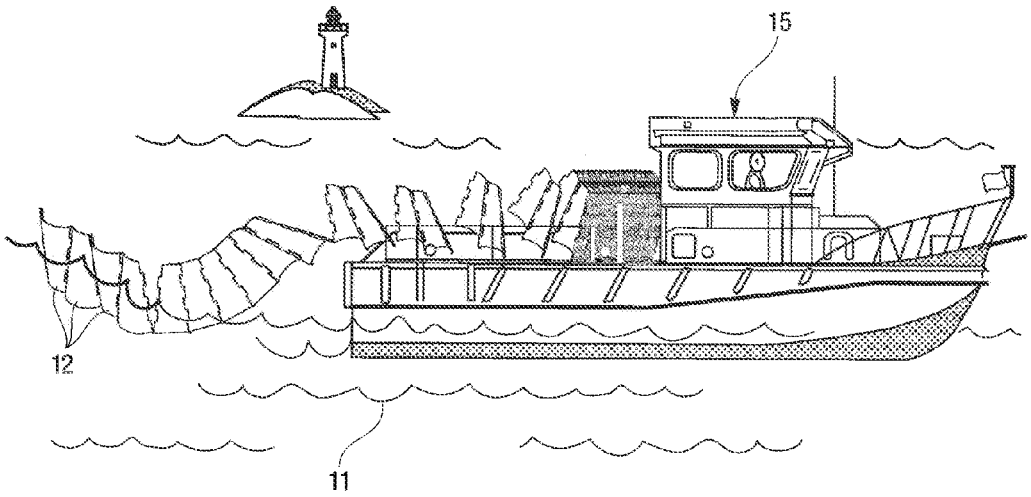
FIG. 7 shows one embodiment of the hurricane barriers being deployed from a boat.

The system can be deployed in a variety of ways, such as by a vessel or via a cable pull system. FIG. 7 shows one method of deploying a hurricane suppression barrier system from a boat. The deployment vessel has a deployment system and a retrieval system on board and may be a commercial ship 15. The barrier system may be stacked in a semi-assembled state on the deployment vessel, as shown in FIG. 7. Then, workers may assemble the barriers into a full barrier system that may then be deployed in the ocean. Alternatively, the barrier system may be stacked in a fully disassembled state and then assembled prior to deployment. In the barrier system of FIG. 7, the barrier panels are not arranged to form barrier units. Instead, the panels are arranged to form a less permeable floating wall.

A group of barrier units 10 can include barrier units 10 of various sizes. For example, a group of barrier units could have a first set of smaller barrier units 10 and a second set of larger barrier units 10. Different size barrier units are useful in different sized fluid bodies. For example, smaller barrier units are more useful closer to the shoreline, and larger barrier units are more useful further out to sea. Thus, the sets could be placed in substantially parallel rows, with the row of larger barrier further out to sea than the row of smaller barrier units. The barrier units protect the structures 60 on land from excessive wave energy.

Figure 8A:
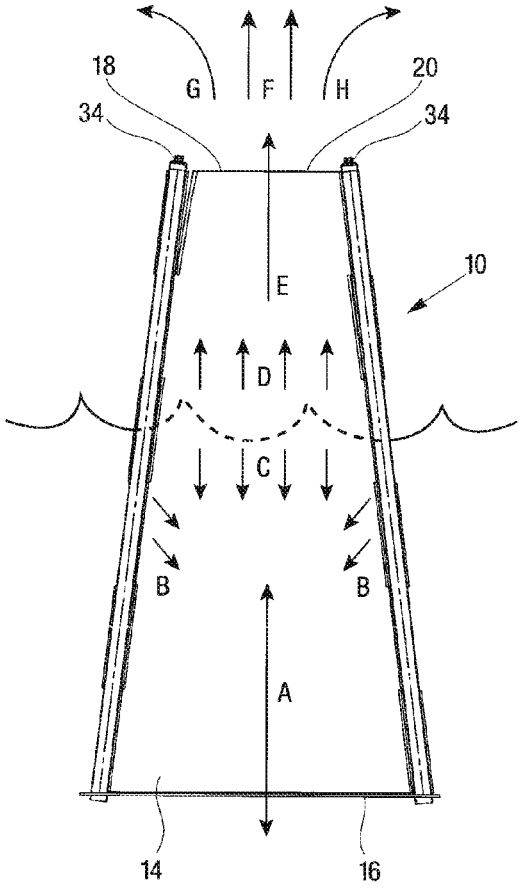
FIG. 8*a* shows a cross sectional view of one embodiment of the hurricane barriers suppressing wave energy when the water level is high relative to the barrier.
Figure 8B:
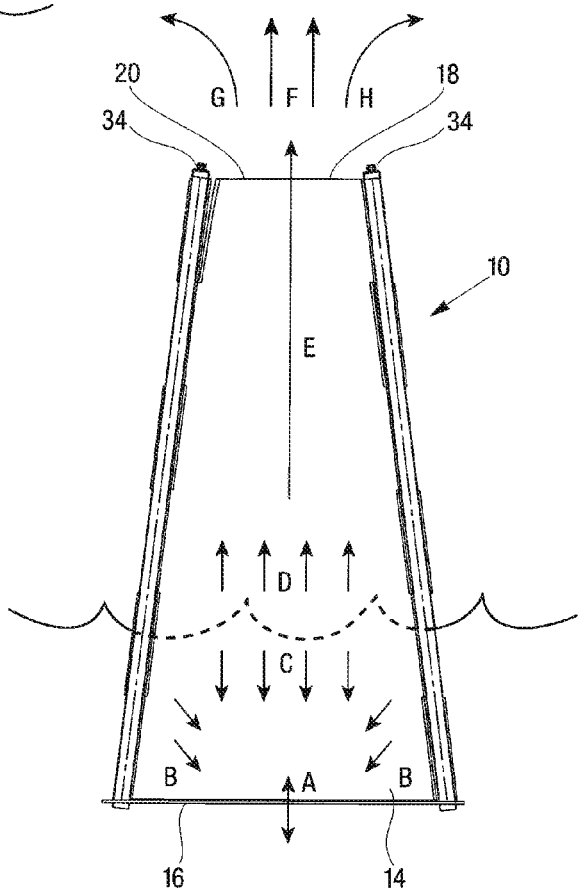
FIG. 8*b* shows a cross sectional view of one embodiment of the hurricane barriers suppressing wave energy when the water level is low relative to the barrier.

FIGS. 8*a* and 8*b* show how the internal structure of the barrier units operates to suppress the energy of fluids within the barrier units, particularly the energy of a hurricane. FIG. 8*a* shows a barrier unit 10 that is seated lower in the water, and FIG. 8*b* shows a barrier unit 10 that is seated higher in the water, such as may occur when additional air is pumped into the connecting rods to increase buoyancy. The arrows show that water may enter the barrier unit 10 through the lower aperture 14, and then move up and down within the barrier unit along arrow A as the wave motion passes the system. When the water moves upwards and hits the sidewalls of the barrier unit, it is deflected inward along arrow B. Additionally, the air within the cone shape is compressed as the water moves upward within the chamber. The water pushes the air upward in direction D, and returns downward along arrow C. The resulting pressure of the air is effectively trying to push the water back down within the chamber. This dampens the wave energy within the barrier unit. Wave energy in the water surrounding the system as a whole is thus dissipated.

Also, as water moves upward within a barrier unit, air is pushed out the top of the unit and out of the upper aperture, along arrow E as shown in FIGS. 8*a* and 8*b*. As the air exits the barrier unit, the air continues upward vertically along arrow F, resulting in vortex cooling effect. Some air travels along arrows G and H. The conical nozzle at the end of the cone shaped barrier only allows the outer shell of the compressed air to escape at that end. The remainder of the air is forced to return in an inner vortex of reduced diameter within the outer vortex. The resulting creates friction within the chamber of the outer and inner layer of air effectively producing a low efficient cooler of the air exiting the top of the barrier unit 10. Furthermore, moving the air in a direction perpendicular to the direction of the weather related air system results in a turbulent air layer that slows the surface velocity of the wind, and, in its extreme state, rolls to an angle and forms a funnel cone that reduces the wave energy similar to water exiting a fire hose.

Flow of fluid around and between the barrier units 10 also dissipates wave energy. When the barrier units are floating at least partially above the surface of the water, the barrier units act on the waves impacting them. The outer walls of the barrier units affect the frequency and amplitude of the waves.

The present invention also provides a method for suppressing the effects of a storm on a coastline or for dissipating wave energy in an ocean. The method includes the steps of providing a barrier system including barrier units such as those described herein, and providing a buoyancy compensation system for the barriers, such as the buoyancy compensation system described herein.

The method may also include the step of providing a location stabilization system for the barriers. The location stabilization system may include a device for substantially positionally securing the barriers to the bottom surface of a body of fluid. The location stabilization system may also include a device for connecting the barrier units together so they are substantially evenly spaced apart and/or substantially constantly spaced apart over time.

The method may also include the steps of first assembling barrier units and then deploying them into the fluid. This step is particularly useful for deploying a large set of barrier units into the ocean. First, a user on a boat or another platform supported on or in the water removes a front panel and a rear panel from at least one stack of front panels and at least one stack of rear panels. Then, the user assembles a barrier unit by securing the front panel to the rear panel. This can be done with a connecting rod, a connecting tube, or another connecting element, as described herein. Then, the user deploys the barrier unit into the body of water.

To provide buoyancy control to the barrier units, the method also includes the step of providing air channels within the barrier units and controlling the amount of air within the air channels. If connecting tubes are used, the air channels may be within the connecting tubes.

Where multiple barrier units are being deployed and are connected to one another, they may be assembled on the boat (or other structure), connected to one another in a desired configuration, and then deployed together, one at a time slowly, or in rapid succession, as needed.

Because there may be insufficient notice to emergency crews when a barrier system will be required, and because it may be dangerous to install a barrier system when it is required, it is advantageous to have a system that can be installed and then remain in the water at a subsurface level until it is needed. When it is needed, the system may then be deployed either manually or remotely through a control system. The barrier system need not interfere with normal water use. It may be permanently installed in such a way that it allows for normal commercial and recreational boating. Additionally, the barrier system may provide additional benefits, such as by forming a reef system that is beneficial to aquatic life, or forming a dynamic pattern of wave creation, for example, one that is ideal for surfing.

In order to power the barrier system, various power sources may be attached to the system. For example, alternative energy sources may be used, such as a wind turbine system to harness the vortex air effect, a solar panel system attached to the outer shell, or a hydroelectric generator to harness wave energy captured within the geometric shell. Furthermore, the barrier system through the power source or similar system could be a platform for supplying alternative clean energy to its surrounding environment.

Figure 9A:
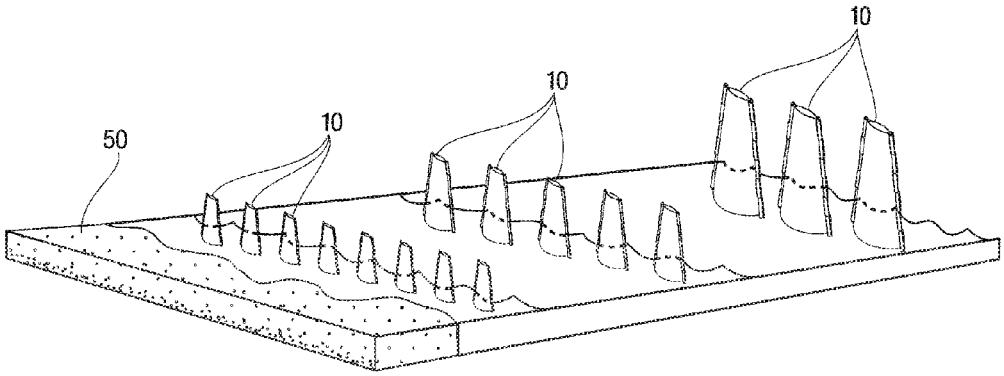
FIG. 9*a* shows one embodiment of a system of hurricane suppression barriers deployed to contain the spread of a contaminant in the ocean.
Figure 9B:
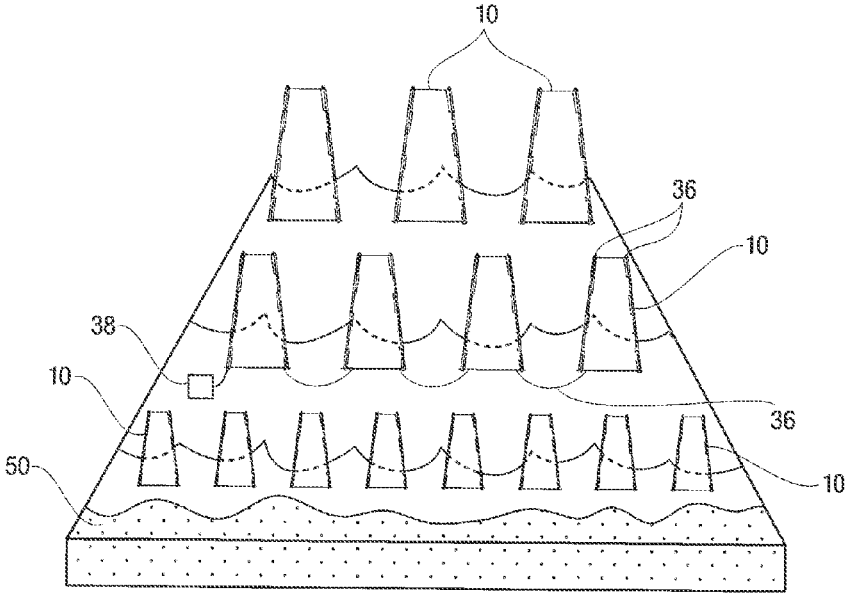
FIG. 9*b* shows one embodiment of a system of suppression barriers deployed along an oil spill in the ocean.

FIGS. 9*a* and 9*b* show how the barrier system may be employed to contain contaminants 50 within the ocean. FIG. 9*a* offers a perspective view, and FIG. 9*b* shows a front perspective view. Rows of progressively larger barrier units can be employed to contain a contaminant within the ocean. Here, the smaller barrier units are placed closest to the contaminant, and the larger barrier units are further away. The barrier system operates to contain the contaminant within a specific area by two mechanisms. First, the barriers offer a physical boundary to limit the dispersion of the contaminant, though this is only a partial barrier where there are gaps between the barrier units. Second, the barrier units dissipate wave energy, thus decreasing the rate of diffusion of the contaminant to surrounding water.

Figure 10:
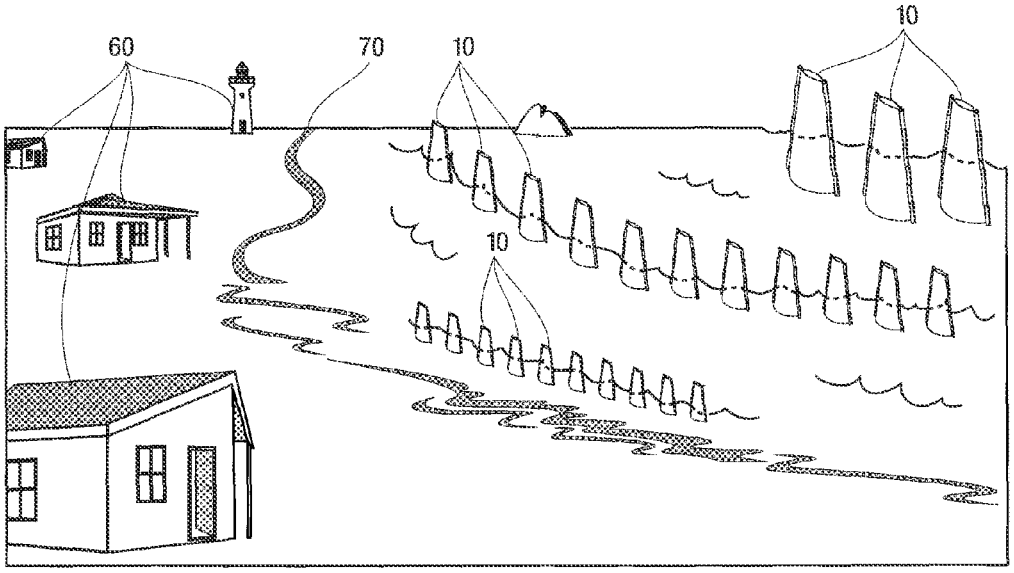
FIG. 10 shows another view of a system of hurricane suppression barriers deployed along a coastline.
Figure 11A:
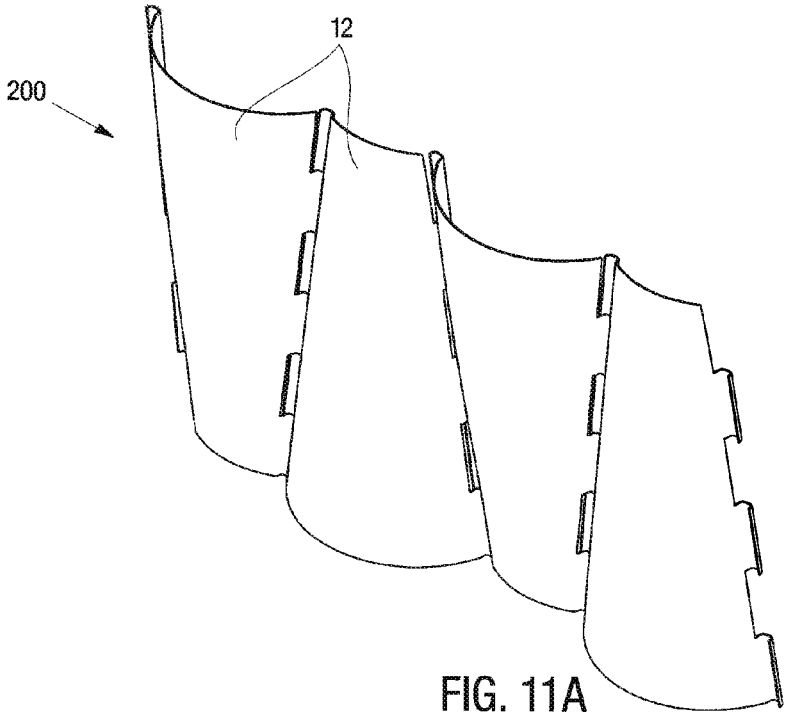
FIG. 11*a* shows a perspective view of one embodiment of a barrier having a single layer of barrier panels.
Figure 11B:
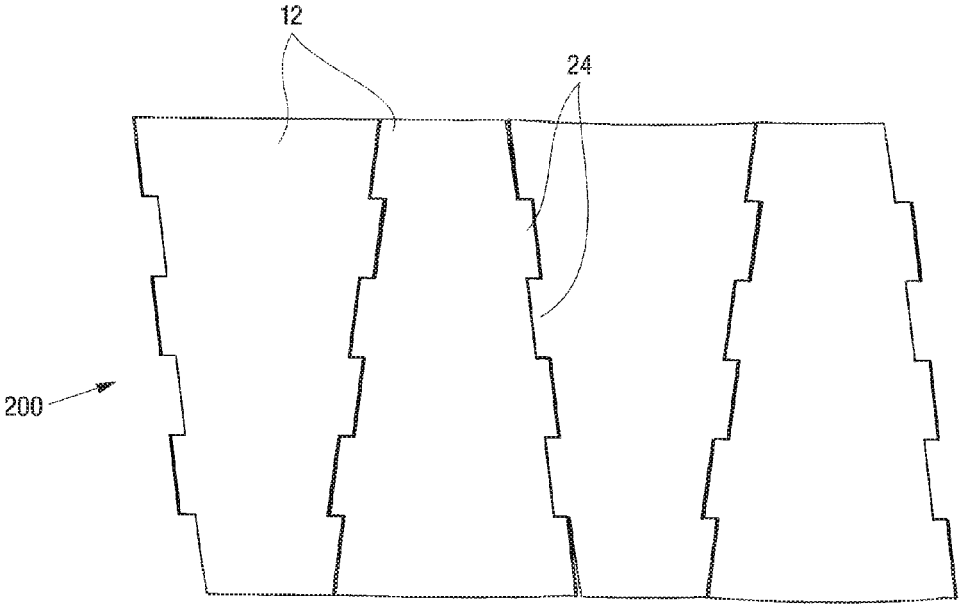
FIG. 11*b* shows a front view of this embodiment.

FIG. 10 shows how the barrier system may be used near a shore line 70. Again, rows of progressively larger barrier units can be deployed. Here, the smaller barrier units are deployed near the shore, and larger units are deployed further out to sea. This type of barrier system can help protect beach front properties 60, such as those shown in FIG. 10.

Where a less permeable barrier is desired, the panels may be spaced closer together. A less permeable barrier would be desirable to provide oil containment barriers for oil released around offshore oil rigs, and potential large scale shipping spills. In some embodiments, where barrier panels 12 are linked directly to adjacent barrier panels 12, without the cone, such as shown in FIGS. 11*a* and 11*b*, a less permeable or impermeable barrier wall 200 may be formed. In this way, a sufficiently high barrier system can prevent a floating contaminant, such as oil, from passing over or under the barrier panels due to energy from the waves.

This system can be deployed rapidly or deployed in a submerged state around oil rigs and surfaced if an issue arises with the rigs. This barrier system need not be designed to pick up the oil, but can contain it until the oil can be removed, thereby minimizing the environmental impact of the oil spill.

Figure 12A:
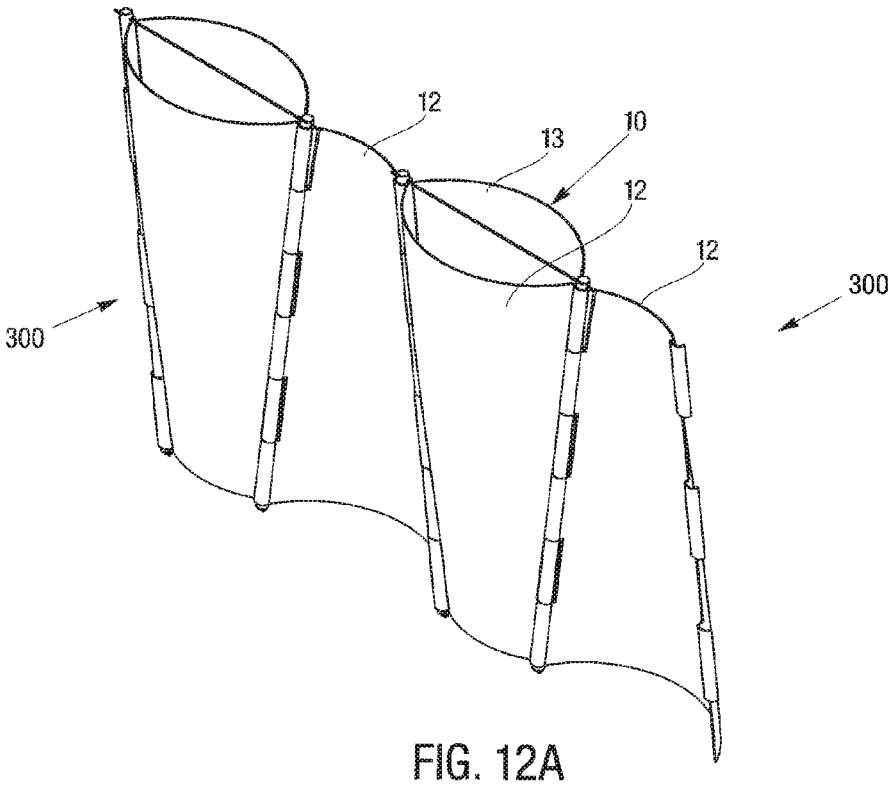
FIG. 12*a* shows a perspective view of one embodiment of a barrier for use as a fire barrier or a traffic barrier.
Figure 12B:
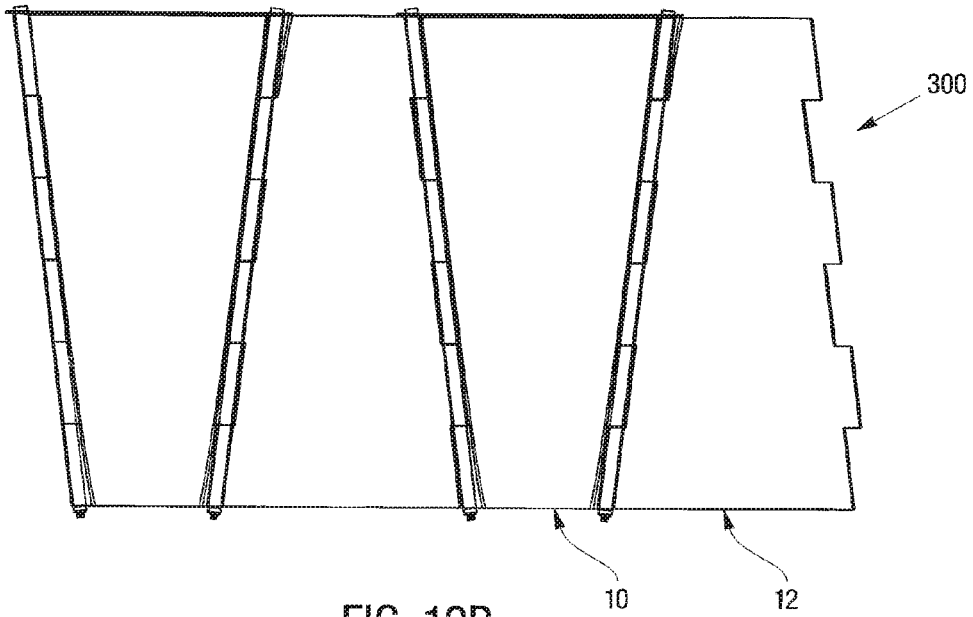
FIG. 12*b* shows a front view of this embodiment.

FIGS. 12*a* and 12*b* show a barrier wall 300 made of a series of alternating barrier units 10 and single panels 12.

Figure 13:
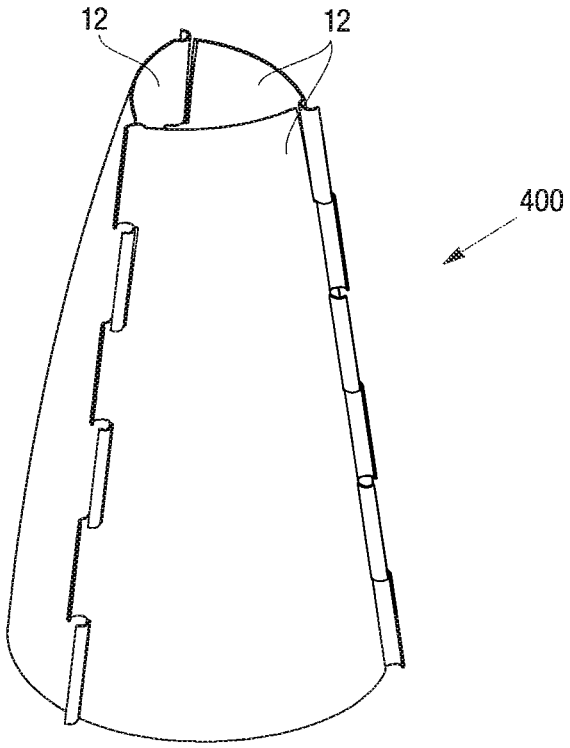
FIG. 13 shows one embodiment of a shelter formed of barrier panels.

FIG. 13 shows how more than two panels can be combined to form a larger, three-panel barrier unit 400. In this way, the barrier panels 12 may be combined to assemble shelters easily adapt to changing size requirements.

It can therefore be seen that the present invention provides a barrier that can be used to protect people and property from damage caused by waves and storms, among other things. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A barrier system for dissipating energy in a body of fluid, the barrier system comprising:

one or more barrier units, each barrier unit comprising an outer wall that defines a hollow inner chamber, each barrier unit having a lower end and an upper end, and each barrier unit being dimensioned such that a first width in a first direction at the upper end is less than a second width in the first direction at the lower end;

a lower aperture defined at the lower end of the one or more barrier units, the lower end configured to allow fluid to flow in and out of the hollow inner chamber;

an upper aperture defined at the upper end of the one or more barrier units, the upper end being configured to allow fluid to flow in and out of the hollow inner chamber; and a buoyancy control system for controlling the buoyancy of the one or more bather units, wherein the buoyancy control system allows each barrier unit to selectively float at a respective selective position with the respective upper aperture positioned above the body of fluid and the lower aperture submerged within the body of fluid, and wherein the buoyancy control system allows each barrier unit to be selectively entirely submerged;

wherein fluid moving upwardly within the inner chamber is deflected inwardly, and the energy of the fluid within the inner chamber is dissipated.

2. The barrier system of claim 1, wherein the outer wall of each of the one or more battier units defines a conical shape.

3. The barrier system of claim 1, wherein the one or more barrier units is a plurality of barrier units, each barrier unit being connected to at least one other barrier unit of the one or more barrier units by at least one linking element, whereby the barrier units float in the body of fluid and are substantially evenly spaced apart.

4. The barrier system of claim 1, wherein the one or more barrier units are a plurality of barrier units arranged in an array.

5. The barrier system of claim 1, wherein the one or more barrier units are a plurality of barrier units positioned in a shape selected from one of: a circle, a straight line, and a triangle.

6. The barrier system of claim 1, wherein at least one of the one or more barrier units is connected to a mooring anchor so that the barrier unit may be substantially positionally secured relative to a bottom surface of the body of fluid.

7. The barrier system of claim 1, wherein the one or more barrier units are free floating.

8. The barrier system of claim 1, wherein the outer wall of each barrier unit further comprises:

a front shell having a first side and a second side;

a rear shell having a first side and a second side;

one or more hinge elements formed on the first and second sides of the front shell;

one or more hinge elements formed on the first and second sides of the rear shell; and the front shell and rear shell being secured together to form a shape that is one of conical and frustoconical.

9. The barrier system of claim 8, wherein the front shell and rear shell are secured together by:

a first connecting rod extending through the hinge elements on the first side of the front shell and the first side of the rear shell; and a second connecting rod extending through the hinge elements on the second side of the front shell and the second side of the rear shell.

10. The barrier system of claim 9, wherein the buoyancy control system comprises: a fluid provided within at least one of the first connecting rod and the second connecting rod, thereby affecting the buoyancy of the respective bather.

11. The barrier system of claim 9, wherein the first connecting rod and second connecting rod are integrally formed.

12. The barrier system of claim 1, wherein the one or more barrier units further comprises:

a first set of bather units; and a second set of harrier units;

wherein the first set of barrier units are dimensioned. to be smaller than the second set of barrier units.

13. The barrier system of claim 12., wherein the first set of barrier units is positioned in a first row, and the second set of barrier units is positioned in a second row, the first and second rows being substantially parallel.

14. A method of suppressing the effects of a storm on a coastline, the method comprising the steps of:

providing a bather system for dissipating energy in a body of a first fluid, the barrier system having a plurality of barrier units, each barrier unit having an outer wall that defines a hollow inner chamber, each barrier unit having a lower end and an upper end, and each barrier unit being dimensioned such that a first width in a first direction at the upper end is less than a second width in the first direction at the lower end; a lower opening defined at the lower end of each bather unit, the lower end being configured to allow the first fluid to flow in and out of the hollow inner chamber; an upper opening defined at the upper end of each bather unit, the upper end being configured to allow a second fluid to flow in and out of the hollow inner chamber; and providing a buoyancy compensation system for the plurality of barrier units;

wherein the buoyancy compensation system allows each bather unit to selectively float at a first position or a second position, the first position being with the respective upper aperture positioned above the body of fluid and the lower aperture submerged within the body of fluid, and the second position being with each barrier unit entirely submerged.

15. The method of claim 14, further comprising the step of:

providing a location stabilization system for the plurality of barrier units.

16. The method of claim 14, wherein the step of providing a barrier system further comprises the steps of:

removing a front panel and rear panel from at least one stack of front panels and at least one stack of rear panels;

assembling a barrier unit by securing the front panel to the rear panel; and deploying the barrier unit within the body of first fluid.

17. The method of claim 16, wherein the step of deploying the barrier unit further comprises one of the steps of:

deploying the barrier unit from a ship and deploying the bather unit by using a cable pull system.

18. The method of claim 14, wherein the step of providing a buoyancy compensation system for the plurality of barrier units further comprises the step of:

providing air channels on the barrier units; and controlling the amount of air within the air channels.

19. A barrier system for dissipating energy in a body of fluid, the barrier system comprising:

one or more barrier units, each harrier unit comprising an outer wall that defines a hollow inner chamber, each barrier unit having a lower end and an upper end, and each barrier unit being dimensioned such that a first width in a first direction at the upper end is less than a second width in the first direction at the lower end;

a lower aperture defined at the lower end of the one or more barrier units, the lower end configured to allow fluid to flow in and out of the hollow inner chamber;

an upper aperture defined at the upper end of the one or more barrier units, the upper end being configured to allow fluid to flow in and out of the hollow inner chamber; and a buoyancy control system for controlling the buoyancy of the one or more barrier units;

wherein fluid moving upwardly within the inner chamber is deflected inwardly, and the energy of the fluid within the inner chamber is dissipated;

wherein the outer wall of each harrier unit further comprises:

a front shell having a first side and a second side;

a rear shell having a first side and a second side;

one or more hinge elements formed on the first and second sides of the front shell;

one or more hinge elements formed on the first and second sides of the rear shell; and the front shell and rear shell being secured together to form a shape that is one of conical and frustoconical;

wherein the front shell and rear shell are secured together by:

a first connecting rod extending through the hinge elements on the first side of the front shell and the first side of the rear shell; and a second connecting rod extending through the hinge elements on the second side of the front shell and the second side of the rear shell;

wherein the buoyancy control system comprises: a fluid provided within at least one of the first connecting rod and the second connecting rod, thereby affecting the buoyancy of the respective barrier.

20. A method of suppressing the effects of a storm on a coastline, the method comprising the steps of:

providing a barrier system for dissipating mew in a body of a first fluid, the barrier system having a plurality of barrier units, each barrier unit having an outer wall that defines a hollow inner chamber, each barrier unit having a lower end and an upper end, and each barrier unit being dimensioned such that a first width in a first direction at the upper end is less than a second width in the first direction at the lower end; a lower opening defined at the lower end of each bather unit, the lower end being configured to allow the first fluid to flow in and out of the hollow inner chamber; an upper opening defined at the upper end of each bather unit, the upper end being configured to allow a second fluid to flow in and out of the hollow inner chamber; and providing a buoyancy compensation system for the plurality of barrier units;

wherein the step of providing a barrier system further comprises the steps of:

removing a front panel and rear panel from at least one stack of front panels and at least one stack of rear panels;

assembling a barrier unit by securing the front panel to the rear panel; and deploying the barrier unit within the body of first fluid.

21. The method of claim 20, wherein the step of deploying the barrier unit further comprises one of the steps of:

deploying the barrier unit from a ship and deploying the barrier unit by using a cable pull system.

* * * * *